United States Patent [19]

Newman

[11] Patent Number: 4,533,808

[45] Date of Patent: Aug. 6, 1985

[54] AN INDUCTION YARN HEATER DEVICE

[75] Inventor: John E. Newman, Spartanburg County, S.C.

[73] Assignee: Phillips Petroleum Company, Bartlesville, Okla.

[21] Appl. No.: 566,464

[22] Filed: Dec. 28, 1983

[51] Int. Cl.[3] ..... H05B 6/14

[52] U.S. Cl. ..... 219/10.49 A; 219/10.61 A; 219/10.57; 219/10.75; 219/469

[58] Field of Search ..... 219/10.49 A, 10.49 R, 219/10.61 A, 10.61 R, 10.75, 10.57, 216, 469, 219/470, 471; 29/402.08, 724; 165/89

[56] References Cited

U.S. PATENT DOCUMENTS

| | | | |
|---|---|---|---|
| 3,216,489 | 11/1965 | Norton | 165/89 X |
| 3,291,204 | 12/1966 | Norton | 165/89 X |
| 3,296,418 | 1/1967 | Johnson | 219/471 |
| 3,612,170 | 10/1971 | Juppet | 219/469 X |
| 3,849,628 | 11/1974 | Abowitz et al. | 219/471 X |
| 3,879,594 | 4/1975 | Shillito | 219/10.49 A |
| 4,003,394 | 12/1976 | Bar-on | 219/469 X |
| 4,105,896 | 8/1978 | Schuster | 219/470 |

*Primary Examiner*—Philip H. Leung
*Attorney, Agent, or Firm*—S. E. Reiter

[57] ABSTRACT

Yarn heater apparatus and process are provided wherein the yarn heater temperature sensing means can be replaced without disassembly of the yarn heater device. The yarn heater apparatus and process of the invention allow ready servicing of temperature sensing devices and is resistant to heater failure upon malfunction of the temperature sensing means.

9 Claims, 10 Drawing Figures

AN INDUCTION YARN HEATER DEVICE

BACKGROUND

1. Field of the Invention

This invention relates to filament and yarn heating apparatus. In another aspect, this invention relates to a yarn heating device which can be readily serviced. In a further aspect, this invention relates to a process for servicing yarn heater devices. In another aspect, this invention relates to a yarn heater device with reduced likelihood of induction heater burnout upon failure of the temperature sensing element.

2. Description of the Prior Art

Yarn heating devices of the rotating roll type are well known in the textile industry. Such prior art yarn heaters comprise a roll providing a yarn engaging surface and a heater associated therewith to heat the roll. One such apparatus involves a rotating steel roll rotating about an induction heater. A common means employed to control the heat input to the induction heater contained in the rotating roll is to position a thermistor between the rotating roll and the induction heater. A problem arises upon failure of the thermistor in that repair of the defective heated rotating roll requires disassembly of the effected rotating roll in order to remove and replace the malfunctioning thermistor; thus repair must await shutdown of the entire yarn processing unit, typically containing tens to hundreds of heated rotating rolls.

Maintenance must therefore be postponed until a given yarn treating cycle has been completed, and then a very time-consuming procedure, i.e., disassembly and reassembly of the entire heated rotating roll is required, since access to the defective thermistor is provided only from the interior of the heated rotating roll.

U.S. Pat. No. 3,296,418 describes a yarn heater device which includes a heat sensing means embedded in the device heater. Complete disassembly of the device would be required to carry out any necessary maintenance on patentee's device, thus maintenance would necessarily be a time consuming process and would be delayed until the yarn processing unit was shut down.

U.S. Pat. No. 3,612,170 deals with a thermal treatment roll for textile yarns comprising a hollow rotor, a stator disposed inside the rotor and a connecting element composed at least partly of a solid, heat-conducting, lubricating material. The connecting element is further provided with a probe for temperature sensing embedded therein. Since access to the probe for repair or replacement requires disassembly of the roll, shut down of the entire yarn processing unit is necessary to allow servicing.

FIG. 1 illustrates a prior art driven roll assembly 1 with a mounting flange 3 and brackets 5 and 7 for attaching the driven roll assembly to a draw twister machine. Drive means for the driven roll assembly 1 is provided by gear 9 which attaches to the drive of the machine, not shown. Rotatable roll 11 is attached by bolt 13 on the front surface 14 of rotatable roll 11 to the rotatable shaft 10 which is driven by gear 9. Rotatable roll 11 is heated by induction coil 15. Mounted on base 8 of the driven roll assembly 1 is plate 17. Attached to the interior face of plate 17 is a continuous ring 19 surrounding rotating member 10 and induction coil 15. Ring 19 has an L-shaped cross section as shown in FIGS. 2 and 3. One leg of ring 19 is attached to the interior face of plate 17 by a plurality of screws 21.

Sensor 25 is attached with epoxy cement 27 to the top surface 28 of the other leg of ring 19 which can be made for example of polytetrafluoroethylene. The sensor is held in position in the annulus defined by the outer surface of induction coil 15 and the inner surface of rotatable roll 11. Temperature sensor 25 is a thermistor sold by Fycon Engineering of Charlotte, N.C., sensor part #1947. Sensor 25 has connecting wires 29 and 39 which connect through respective solder dots 31 and 32 into connectors 33 (and 34 not shown) and two wires 35 and 37. Wires 35 and 37 are connected to the controls (not shown) of a draw twister. Input to induction coil 15 for heating rotatable roll 11 to the desired temperature for the yarn (not shown) wrapped on rotatable roll 11 is provided by the draw twister control. The connectors 33 and 34 and wires 35 and 37 are protected by tubular insulation 41 and 42 held in place by epoxy cement 43. A slot 45 (shown in FIG. 2) is provided in plate 17 for passage of the wires form sensor 25. A cable 46 also attached to the draw twister machine controls (not shown) provides power by connections not shown to induction coil 15 through slot 47 (shown in FIG. 1) in plate 17. Rotatable roll 11 has a back surface 23 (shown in FIGS. 1 and 3) adjacent to wires 29 and 39 which are connected to solder dots 31 and 32.

In prior art mounting of sensor 25 on continuous ring 19 as described in FIGS. 1, 2 and 3, the sensor may from time to time become inoperative and have to be changed. Frequently, a failure of the sensor can result in failure of the induction heater. The heater is subject to burn-out if the sensor becomes inoperative and thus signal the heater to continue heating in efforts to achieve a desired set temperature. In order to change the sensor mounted as taught by the prior art and as described in FIGS. 1, 2 and 3, the entire draw twister unit must be shut down and the driven roll disassembled since the only access to the defective thermistor is from the interior of the driven roll.

It is therefore an object of this invention to provide a yarn heater device. It is a further object of this invention to provide a yarn heater device which can be readily serviced to replace temperature sensing means disposed therein. It is also an object of this invention to provide a yarn heater device which can be serviced to replace temperature sensing means disposed therein without disassembling the yarn heater device. It is another object of this invention to provide a yarn heater device wherein access to the temperature sensing means is provided from the exterior of the rotatable roll. It is yet another object of this invention to provide a yarn heater device which is resistant to heater failure upon malfunction of the yarn heater device temperature sensing means.

It is another object of this invention to provide a process for replacing the yarn heater device temperature sensing means. It is a further object of this invention to provide a process for replacing the yarn heater device temperature sensing means without disassembling the yarn heater device. It is another object of this invention to provide an apparatus and process wherein the yarn heater device temperature sensing means can be replaced without disrupting the operation of the entire yarn processing unit.

It is another object of this invention to provide support means which maintain the yarn heater device temperature sensing means in close proximity to the inner surface of the rotatable roll.

It is yet another object of this invention to provide support means which maintain the yarn heater device temperature sensing means in position in the annulus defined by the inner surface of the rotatable roll and the outer surface of the heater. It is a further object of this invention to provide support means for a yarn heater device temperature sensing means which prevents heater burnout upon malfunction of the yarn heater device temperature sensing means.

It is another object of this invention to provide a process for conversion of a prior art yarn heater device wherein disassembling the yarn heater device is required in order to service the temperature sensing means to a yarn heater device wherein no disassembly is required in order to service the temperature sensing means. It is yet another object of this invention to provide a process for conversion of a prior art yarn heater device wherein access to the temperature sensing means is provided only from the interior of the rotatable roll to a yarn heater device with access to the temperature sensing means provided from the exterior of the rotatable roll.

These and other objects of my invention will become apparent from the disclosure and appended claims.

SUMMARY OF THE INVENTION

In accordance with one embodiment of my invention, there is provided a yarn heater device wherein the yarn heater temperature sensing means can be replaced without disassembly of the yarn heater device.

In accordance with another embodiment of my invention, the yarn heater device temperature sensing means is removed and replaced without disrupting the operation of the entire yarn processing unit.

In accordance with yet another embodiment of my invention, there is provided a process for the modification of a yarn heater device with access to the temperature sensing means only from the interior of the rotatable roll to a yarn heater device wherein access to the temperature sensing means is provided from the exterior of the rotatable roll.

DESCRIPTION OF THE PREFERRED EMBODIMENTS

Figure 4:
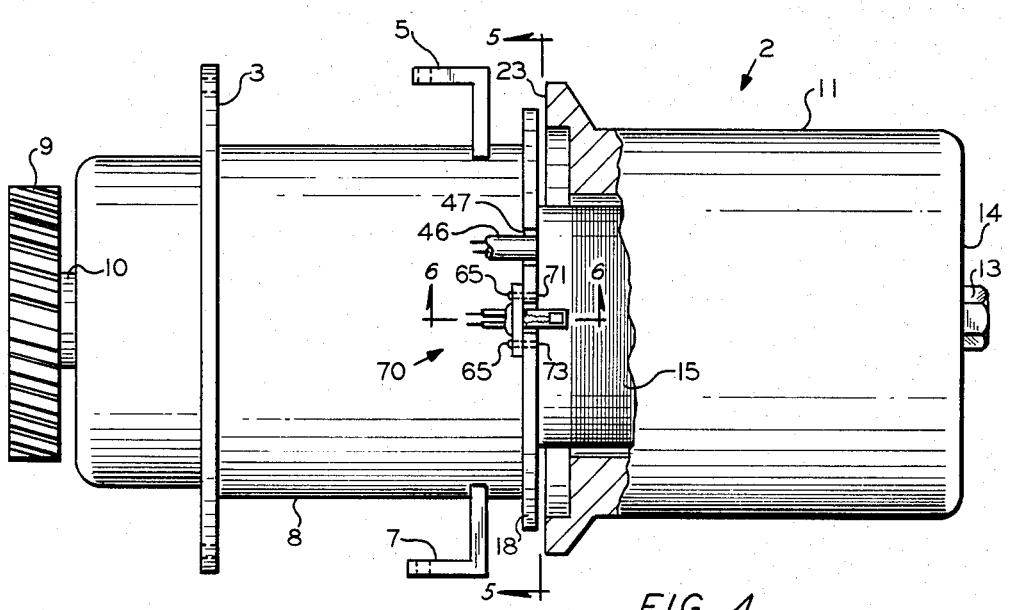
FIG. 4 is a plan view partly in cross section of an embodiment of a rotatable roll of the invention and its associated driving gear.

The apparatus and process of the invention are more fully understood by referring to the drawings, and in particular FIGS. 4–8. FIG. 4 illustrates driven roll assembly 2 with mounting flange 3 and brackets 5 and 7 for attaching the driven roll assembly 2 to a yarn processing unit such as a draw twister. Drive means for the driven roll assembly 2 is provided by gear 9 which attaches to the drive of the machine, not shown. Rotatable roll 11 is attached by bolt 13 on the front surface 14 of rotatable roll 11 to rotatable shaft 10 which is driven by gear 9. Rotatable roll 11 is heated by suitable means such as for example induction coil 15.

Plate 18 is mounted on base 8 of the driven roll assembly 2. Plate 18 has an interior face and an exterior face, and is attached to base 8 adjacent to the back end of heater 15. Plate 18 extends radially outward with respect to rotatable shaft 10. The interior face of plate 18 is positioned adjacent to the back end of rotatable roll 11.

Figure 5:
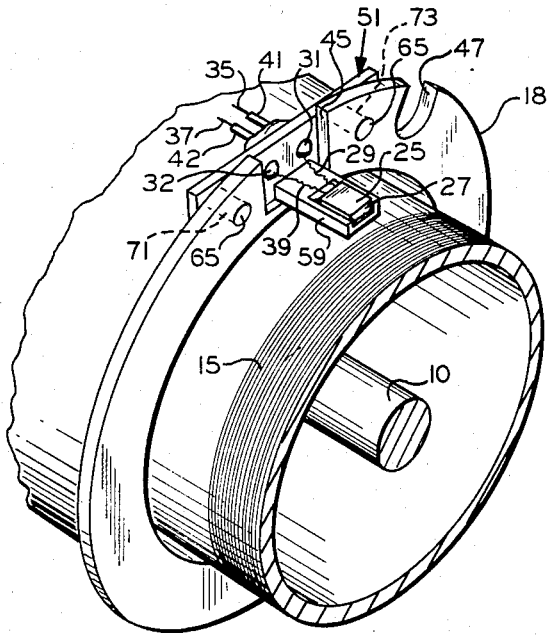
FIG. 5 is an enlarged pictorial view of a portion of the sensor mounting bracket assembly 70 shown in FIG. 4.
Figure 6:
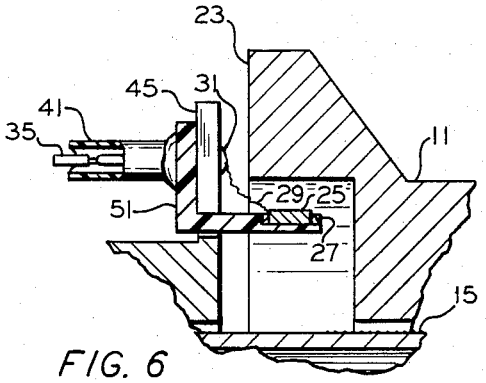
FIG. 6 is an enlarged partial cross section along the lines of 6—6 of FIG. 4.
Figure 7:
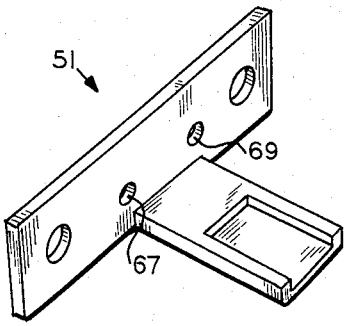
FIG. 7 is a pictorial view of an embodiment of the support means of the invention.
Figure 8:
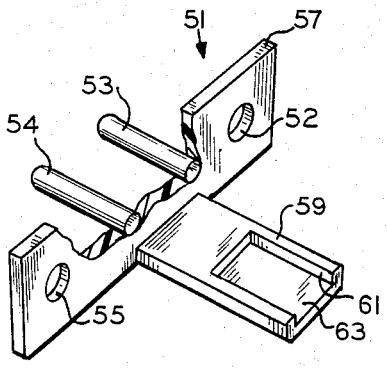
FIG. 8 is a pictorial view of the sensor mounting bracket 51 partly in cross section showing the connectors 53 and 544 extending through the bracket.

Attention is drawn now to FIGS. 4, 5 and 6, illustrating an embodiment of the temperature sensing means mounting bracket assembly 70 of the instant invention, wherein sensor 25 is mounted on surface 63 of the depression or inset 61 in plate 59 of bracket 51. Epoxy cement 27 is used to secure the sensor 25 in inset 61. Sensor 25 can be any suitable temperature sensing means such as for example a thermocouple, a thermistor or the like.

Bracket 51 is comprised of pieces 57 and 59 which can be one unitary piece (made, for example, by being cut from an angular object of suitable material; or by forming from a flat plate, by injection molding, or fastening two pieces together by welding or other means such as Epoxy cement, etc). Suitable materials for use in forming bracket 51 are materials which are of relatively low-heat conductivity and non-electrical conducting. Suitable materials for construction include polyethylene, polypropylene, poly(phenylene sulfide), polytetrafluoroethylene and the like. Preferably the bracket 51 is one unitary piece made by cutting a plastic angular material such as polytetrafluoroethylene. Bracket 51 is provided with mounting holes 52 and 55 for screws 65 for mounting the bracket to the exterior face of plate 18. Bracket 51 is also provided with holes 67 and 69 for connecting wires 29 and 39 of sensor 25 to wires 35 and 37 through metal connectors 53 and 54. Wires 29 and 39 are connected to connectors 53 and 54 by soldering, thereby forming solder dots 31 and 32 as shown in FIG. 5.

In the apparatus shown in FIGS. 4, 5 and 6, piece 57 of bracket 51 is attached to the exterior (i.e. back side) of plate 18 so that piece 59 extends through slot 45 of plate 18 and extends beneath the surface of rotatable roll 11 and is held in close proximity to the inner surface of rotatable roll 11, for example, by extending into the annulus defined by the outer surface of the induction coil 15 and the inner surface of rotatable roll 11. The bracket 51 positions sensor 25 in a manner that protects the wires 29 and 39 from being shorted by being touched by the adjacent metal parts and which allows removal of the temperature sensing means 25 from the annulus without disassembling rotatable roll 11 from rotatable shaft 10. Screws 65 are attached to plate 18 from the exterior of the assembly 2 by tapped holes 71 and 73. Mounting of the sensor 25 on bracket 51 as shown in FIGS. 4, 5 and 6 protects the wires 29 and 39 and solder dots 31 and 32 from the adjacent metal parts thereby reducing the likelihood of contact between wires 29 and/or 39 and the back surface 23 of rotatable roll 11, consequently reducing the number of malfunctions of sensor 25 and induction coil 15. In accordance with the invention, sensor 25 can be replaced, if necessary, without shutting down the machine since the bracket assembly 70 is removable from the exterior of the driven roll asssembly 2 without the need to disassemble assembly 2. As indicated in FIG. 4, there is sufficient room between brackets 5 and 7 for an operator to merely reach behind driven roll assembly 2 and remove screws 65 even with the driven roll assembly intact. However, it is preferred that the sensor be changed when the machine is shut down for obvious safety reasons.

Figure 2:
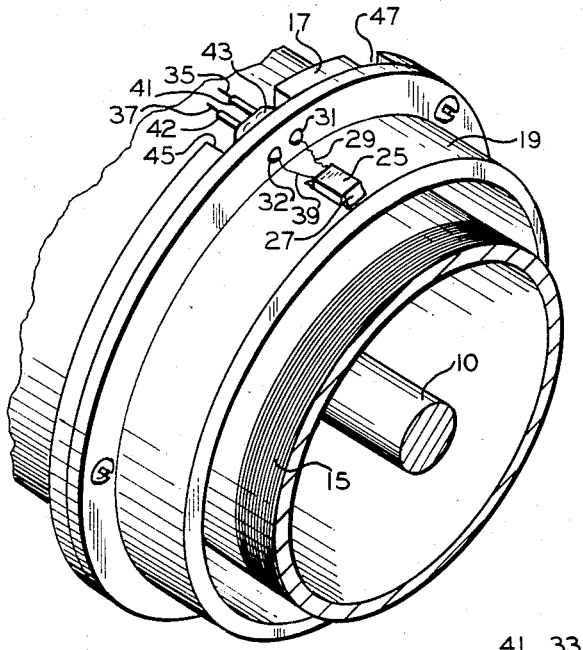
FIG. 2 PRIOR ART
FIG. 2 is an enlarged pictorial view of a portion of the sensor mounting assembly 40 shown in FIG. 1.
Figure 3:
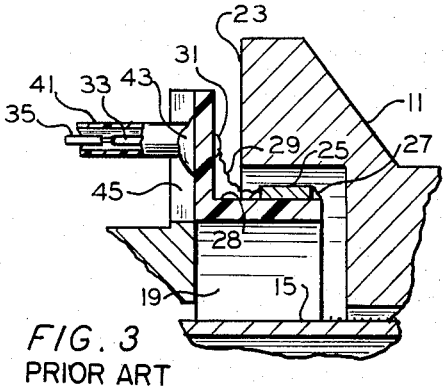
FIG. 3 PRIOR ART
FIG. 3 is an enlarged partial cross section along the lines 3—3 of FIG. 1.

Sensor 25 can be readily changed as follows, referring to FIGS. 4, 5 and 6: remove screws 65, remove the first bracket assembly 70 from contact with the exterior of plate 18, replace the first bracket assembly 70 with a second bracket assembly 70 containing a second sensor 25 mounted in the same manner as described previously by bringing the second bracket assembly into contact with the exterior of plate 18 and fastening the bracket assembly to the exterior face of plate 18 by suitable means such as for example screws 65. The replacement of the sensor in this manner does not require disassembly of driven roll assembly 2, i.e., the removal of the rotatable roll 11 and ring 19 as previously described for driven roll assembly 1 with respect to FIGS. 1, 2 and 3. In addition, there is ample access for an operator to reach in between brackets 5 and 7 so that screws 65 and bracket assembly 70 can be removed and replaced while the entire yarn heater unit continues to operate. The driven roll assembly of the prior art shown in FIG. 1 and the embodiment of the invention shown in FIG. 4 are mounted on a draw twister such as for example Rieter Draw Twister Model J-5 10A, or can be mounted on a draw winder such as for example a Rieter Draw Winder Model J-6 2A. The mounting of the sensor as shown in FIGS. 4, 5 and 6 can also be advantageous to machines having godet rolls such as yarn drawing machines, melt spinning apparatus, and the like.

Figure 1:
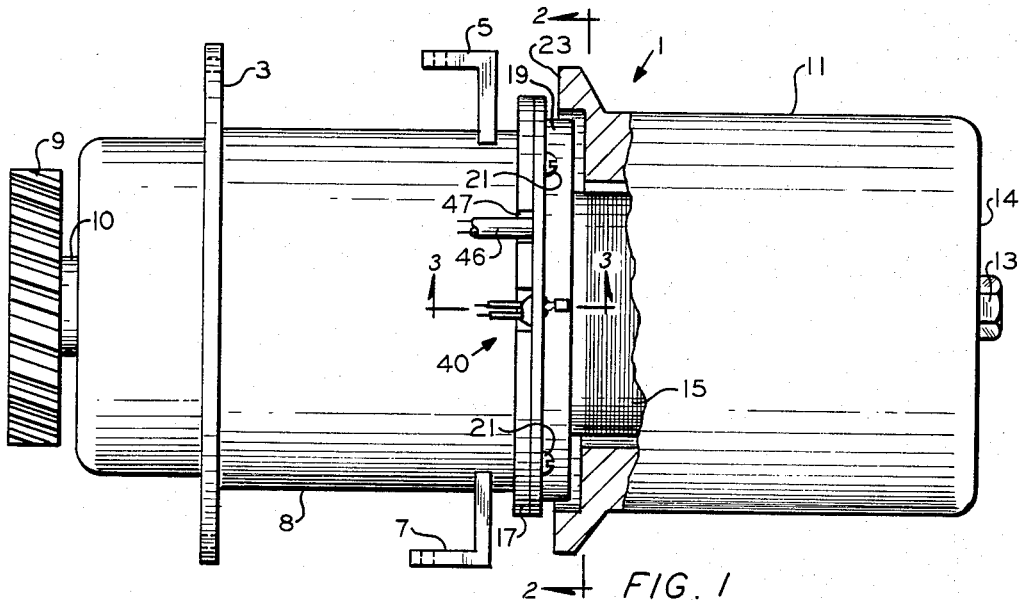
FIG. 1 PRIOR ART
FIG. 1 is a plan view partly in cross section of a prior art driven roll and its associated driving gear removed from its mounting on a draw twister machine.

In order to convert the prior art yarn heater device as illustrated in FIG. 1 to the inventive yarn heater device as illustrated in FIG. 4, the following steps are carried out. Shut down the draw twister machine, disassemble driven roll assembly 1 as described above with reference to FIG. 1 for repair of malfunctioning prior art yarn heater apparatus, i.e., remove nut 13 on front surface 14 of rotatable roll 11, attach a mechanical puller to holes (not shown) in the surface of rotatable roll 11, remove rotatable roll 11 with the puller, remove screws 21 and ring 19 along with the sensor assembly 40. At least one, and preferably two conveniently located holes, such as for example holes 71 and 73 in plate 17 are tapped to give the desired screw thread to accomodate screws 65. The modified plate 17 now corresponds to plate 18 illustrated in FIGS. 4 and 5. Then rotatable roll 11 and nut 13 are replaced without providing a new ring 19 or a new sensor assembly 40. Now, bracket assembly 70 can be mounted as described above, i.e., piece 57 of bracket 51 is attached to the exterior of plate 18 so that the piece 59 of bracket 51 extends through slot 45 of plate 18 and extends beneath the surface of rotatable roll 11 into the annulus defined by the inner surface of rotatable roll 11 and the outer surface of heater 15. Screws 65 are attached to plate 18 from the exterior face of the place by tapped holes 71 and 73.

Figure 9:
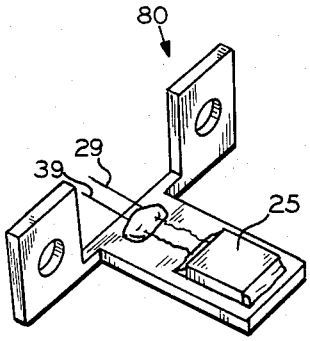
FIGS. 9 and 10 are pictorial views of alternate embodiments of the sensor support means of the invention.
Figure 10:
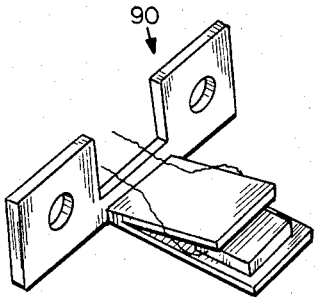

Although the invention has been described in great detail with respect to bracket 51 (FIGS. 5–8) as a means for providing access to sensor 25 without the need to disassemble the driven roll assembly 2, applicant does not intend to be limited by the specific details of bracket 51. Thus, for example, FIGS. 9 and 10 illustrate equally suitable alternate embodiments 80 and 90, respectively, which provide the same advantages as described above for bracket 51. Clearly, numerous other alternative designs could be set forth such as for example the use of a contact adhesive instead of any screws, the use of a clamp attached to the yarn heater device which maintained the bracket in place and the like. Such modifications are well within the capability of one skilled in the art; hence, it is not believed to be necessary to further burden the disclosure with additional detail.

EXAMPLE

A technician assigned to change the sensor assembly of the prior art (FIGS. 1, 2 and 3) on a Rieter Draw Twist Machine Model J-5 10A required about thirty minutes to complete the disassemble, change, reassemble procedure required for sensor replacement.

The same technician assigned to change the sensor assembly of the invention on the same machine (FIGS. 4, 5 and 6) required only about five minutes to complete the remove, change, reinsert procedure of the present invention, which requires no disassembly of the driven roll assembly 2.

The same technician was assigned to convert the driven roll assembly 1 of the prior art to driven roll assembly 2 of the present invention. The required steps included removal of the nut 13, removal of rotatable roll 11, removal of screws 21 and ring 19. Holes 71 and 73 were tapped in plate 17, then rotatable roll 11 and nut 13 were replaced. Finally bracket 70 was inserted through slot 45 of plate 18 and brought into contact with the exterior of plate 18. Finally, screws 65 were attached to plate 18; the entire changeover procedure requiring about 35 minutes.

That which is claimed:

1. An apparatus consisting essentially of a base having a rotatable shaft, a rotatable roll having a front end and a back end and an inner surface, wherein said heater is attached to said base and positioned between said rotatable shaft and said inner surface of said rotatable roll, a plate having an interior face and an exterior face wherein said plate is attached to said base adjacent to the back end of said heater and extends radially outward with respect to said rotatable shaft, and wherein said interior face of said plate is positioned adjacent to the back end of said rotatable roll, a temperature sensing means, and a support means attached to said base and supporting said temperature sensing means in close proximity to said inner surface of said rotatable roll and said outer surface of said heater; wherein said support means comprises:

a first piece having a face side and a back side, a second piece having a face side and a back side; wherein said first and second pieces are joined together in perpendicular orientation to one another such that said face side of said first piece and said face side of said second piece face the interior of the right angle defined by the joinder of said first and second pieces; wherein said second piece has a depression on the face said which extends from the end opposite the end where said first and said second pieces and joined, and extends toward the end where said first and said second pieces are joined; and wherein said face side of said first piece is brought into contact with said exterior face of said plate and attached to said exterior face in a manner to premit removal of said support means; and, wherein said temperature sensing means can be removed from said close proximity to said inner surface of said rotatable roll, without disassembling said rotatable roll from said rotatable shaft.

2. An apparatus in accordance with claim 1 wherein said first and second pieces are one unitary article having an L-shaped cross section and are constructed of polytetrafluoroethylene.

3. An apparatus in accordance with claim 1 wherein said temperature sensing means is a thermistor.

4. An apparatus in accordance with claim 3 wherein the input to said heater is in direct communication with the output of said thermistor.

5. An apparatus in accordance with claim 1 wherein said support means is constructed of material with low-heat conductivity.

6. An apparatus in accordance with claim 1 herein said support means is constructed of non-electric conducting material.

7. An apparatus in accordance with claim 1 wherein said support means is constructed of polytetrafluoroethylene.

8. An apparatus in accordance with claim 1 wherein said heater is coaxially aligned with respect to said rotatable roll, wherein the outer surface of said heater and the inner surface of said rotatable roll form an annulus, and wherein said support means is attached to said base within said annulus in a manner to permit removal of said support means, and thus said temperature sensing means from said annulus without disassembling said rotatable roll from said rotatable shaft.

9. An apparatus consisting essentially of a base having a rotatable shaft, a rotatable roll having a front end and a back end and an inner surface wherein said rotatable roll is coaxially aligned with said rotatable shaft, and wherein said front end of said rotatable roll is attached to said rotatable shaft, drive means for said rotatable roll, a heater having an outer surface and a front end and a back end, wherein the back end of said heater is attached to said base and positioned between said rotatable shaft and said inner surface of said rotatable roll and coaxially aligned therewith, and wherein the outer surface of said heater and the inner surface of said rotatable roll form an annulus, a plate having an interior face and an exterior face wherein said plate is attached to said base adjacent to the back end of said heater and extends radially outward with respect to said rotatable shaft, and wherein said interior face of said plate is positioned adjacent to the back of said rotatable roll, a thermistor, and a support means attached to said base and supporting said thermistor within said annulus wherein said support means comprises:

a first piece having a face side and a back side, a second piece having a face side and a back side wherein said first and second pieces are joined together in perpendicular orientation to one another such that said face side of said first piece and said face side of said second piece face the interior of the right angle defined by the joinder of said first and second pieces wherein said second piece has a depression on the face side which extends from the end opposite the end where said first and said second pieces are joined, and extends toward the end where said first and said second pieces are joined; wherein said face side of said first piece is brought into contact with said exterior face of said plate and attached to said exterior face in a manner to permit removal of said support means, and thus said temperature sensing means from said annulus without disassembling said rotatable roll from said rotatable shaft; and wherein said support means is constructed of polytetrafluoroethylene.

* * * * *

UNITED STATES PATENT AND TRADEMARK OFFICE

CERTIFICATE OF CORRECTION

PATENT NO. : 4,533,808

DATED : August 6, 1985

INVENTOR(S) : John E. Newman

It is certified that error appears in the above-identified patent and that said Letters Patent is hereby corrected as shown below:

Column 7, line 3, "said" should be ---side---.

Column 7, line 5, "and" should be ---are---.

Column 7, line 28, "herein" should be ---wherein---.

Column 7, line 29, "non-electric" should be ---non-electrical---.

Signed and Sealed this

*Third* Day of *June 1986*

[SEAL]

*Attest:*

DONALD J. QUIGG

*Attesting Officer*

*Commissioner of Patents and Trademarks*